US012214291B2

(12) United States Patent
Perrin

(10) Patent No.: US 12,214,291 B2
(45) Date of Patent: Feb. 4, 2025

(54) CONTAINER INFLATOR SYSTEM AND A METHOD FOR INFLATING A BALLOON

(71) Applicant: BOTI GLOBAL LIMITED, Kowloon (HK)

(72) Inventor: Steve Perrin, Kowloon (HK)

(73) Assignee: BOTI GLOBAL LIMITED, Kowloon (HK)

( * ) Notice: Subject to any disclaimer, the term of this patent is extended or adjusted under 35 U.S.C. 154(b) by 279 days.

(21) Appl. No.: 17/775,055

(22) PCT Filed: Dec. 23, 2019

(86) PCT No.: PCT/CN2019/127568

§ 371 (c)(1),
(2) Date: May 6, 2022

(87) PCT Pub. No.: WO2021/098001

PCT Pub. Date: May 27, 2021

(65) Prior Publication Data

US 2022/0387901 A1 Dec. 8, 2022

(30) Foreign Application Priority Data

Nov. 21, 2019 (CN) ..... 201911150523.3

(51) Int. Cl.
*A63H 27/10* (2006.01)

(52) U.S. Cl.
CPC ..... *A63H 27/10* (2013.01); *A63H 2027/1033* (2013.01); *A63H 2027/1041* (2013.01); *A63H 2027/1091* (2013.01)

(58) Field of Classification Search
CPC ..... A63H 27/10; A63H 2027/1091; A63H 2027/1033
See application file for complete search history.

(56) References Cited

U.S. PATENT DOCUMENTS 4,809,483 A * 3/1989 Lovik ..... A63H 27/10 53/385.1
4,974,393 A * 12/1990 Rich ..... A63H 27/10 141/10
5,088,267 A 2/1992 Gee
5,205,109 A 4/1993 Conway
(Continued)

FOREIGN PATENT DOCUMENTS

CN 204107049 U 1/2015

OTHER PUBLICATIONS

Bibliographic data including English abstract for CN 204107049 U, 1 page.

(Continued)

*Primary Examiner* — Jason K Niesz
(74) *Attorney, Agent, or Firm* — Ware, Fressola, Maguire & Barber LLP

(57) ABSTRACT

A container inflator system (100) includes a suction chamber (102) arranged to expand the container within the suction chamber (102) while maintaining at least one opening for accessing the container; an inflation device (104) arranged to further inflate the container when the container is removed from the suction chamber (102); and a delivery valve (302) arranged to seal the container so as to maintain the expanded state of the container when it is removed from the suction chamber (102).

21 Claims, 8 Drawing Sheets

(56) References Cited

U.S. PATENT DOCUMENTS

| | | | | |
|---|---|---|---|---|
| 6,141,941 | A * | 11/2000 | Carroll | A63H 27/10 53/385.1 |
| 2009/0296372 | A1 * | 12/2009 | Schrimmer | A63H 27/10 362/189 |

OTHER PUBLICATIONS

International Search Report (ISR) for PCT/CN2019/127568 mailed Aug. 19, 2020, 4 pages.
Written Opinion of the International Searching Authority (ISA/CN) for PCT/CN2019/127568 mailed Aug. 19, 2020, 4 pages.

* cited by examiner

CONTAINER INFLATOR SYSTEM AND A METHOD FOR INFLATING A BALLOON

TECHNICAL FIELD

The present invention relates to a container inflator system, and particularly, although not exclusively, to a container inflator system arranged to inflate balloons or the like so as to allow objects to be placed within.

BACKGROUND

Balloons are a common toy which is enjoyed by children and adults alike. There are various versions of balloon toys including use of different materials to make the balloons, forming the balloon with different shapes or the use of lighter than air gases to inflate the balloons to create balloons that float in the atmosphere.

One recent trend has been to inflate balloons with different toys or decorative items so as to improve the appearance or enjoy-ability of the balloon. One such product is to insert decorative items within an inflated balloon such as LED lights or toys. These add to the interests of the balloons and can also change the effect of the balloon. Examples of such balloons may be to include festive lights into the balloon during Christmas, or romantic items such as flowers or rose pedals during Valentine's day, or the inclusion of soft toys for birthday parties.

However, the manufacturing of such balloons is complicated by the difficulty in the insertion of items into a balloon followed by the correct inflation of the balloon. This process cannot be achieved with simple means as it is difficult to insert objects within a balloon without tearing the balloon itself. Accordingly, the creation of such balloons that house various toys or objects within typically require specialist equipment that are large and expensive. In turn, such balloons are typically created by specialist toy, balloon or party stores.

SUMMARY OF THE INVENTION

In accordance with a first aspect of the present invention, there is provided a container inflator system comprising:

- a suction chamber arranged to expand the container within the suction chamber while maintaining at least one opening for accessing the container; and
- an inflation apparatus arranged to further inflate the container when the container is removed from the suction chamber.

In an embodiment of the first aspect, the container inflator system further comprises a delivery valve arranged to seal the container so as to maintain the expanded state of the container when the container is removed from the suction chamber.

In an embodiment of the first aspect, the inflation apparatus and the suction chamber are operated by a pumping device.

In an embodiment of the first aspect, the pumping device includes a valve arrangement arranged to deliver suction pressure to the suction chamber.

In an embodiment of the first aspect, the valve arrangement is further arranged to deliver inflation pressure to the inflation apparatus.

In an embodiment of the first aspect, the valve arrangement includes a plurality of one way valves arranged to create the suction pressure and the inflation pressure when the pumping device is actuated.

In an embodiment of the first aspect, the pumping device includes a cylinder connected to the valve arrangement.

In an embodiment of the first aspect, the plurality of one way valves are arranged such that the suction pressure and the inflation pressure is created on a stroke of a piston of the cylinder.

In an embodiment of the first aspect, the suction chamber is defined by a dome member arranged to be engaged to a base portion.

In an embodiment of the first aspect, the dome member is engaged to the base portion by screw fit.

In an embodiment of the first aspect, the base portion is part of a base member arranged to engage with the inflator apparatus.

In an embodiment of the first aspect, the base member includes one or more storage compartments.

In an embodiment of the first aspect, the delivery valve includes a one way valve.

In an embodiment of the first aspect, the one way valve is engaged to an annular member arranged to couple with the container.

In an embodiment of the first aspect, the coupling between annular member and the container is substantially air tight.

In an embodiment of the first aspect, the container is a balloon.

In accordance with a second aspect of the present invention, there is provided a method for inflating a balloon comprising the steps of:

- expanding a balloon by using suction pressure;
- further inflating the balloon by delivering inflation pressure to the balloon, wherein the suction pressure and the inflation pressure are provided by a pumping device.

In an embodiment of the second aspect, the pumping device includes a valve arrangement arranged to direct suction pressure to the balloon and inflation pressure to the balloon.

In an embodiment of the second aspect, the method further includes the step of sealing the balloon after the balloon is expanded by the suction pressure.

In an embodiment of the second aspect, the sealing of the balloon is performed by a delivery valve.

In an embodiment of the second aspect, the delivery valve is arranged to couple with the pumping device to inflate the balloon.

In an embodiment of the second aspect, the method further includes a step of inserting objects into the balloon.

In an embodiment of the second aspect, the step of inserting objects into the balloon is performed after the balloon is expanded by suction pressure.

BRIEF DESCRIPTION OF THE DRAWINGS

Embodiments of the present invention will now be described, by way of example, with reference to the accompanying drawings in which.

DETAILED DESCRIPTION

Figure 1A:
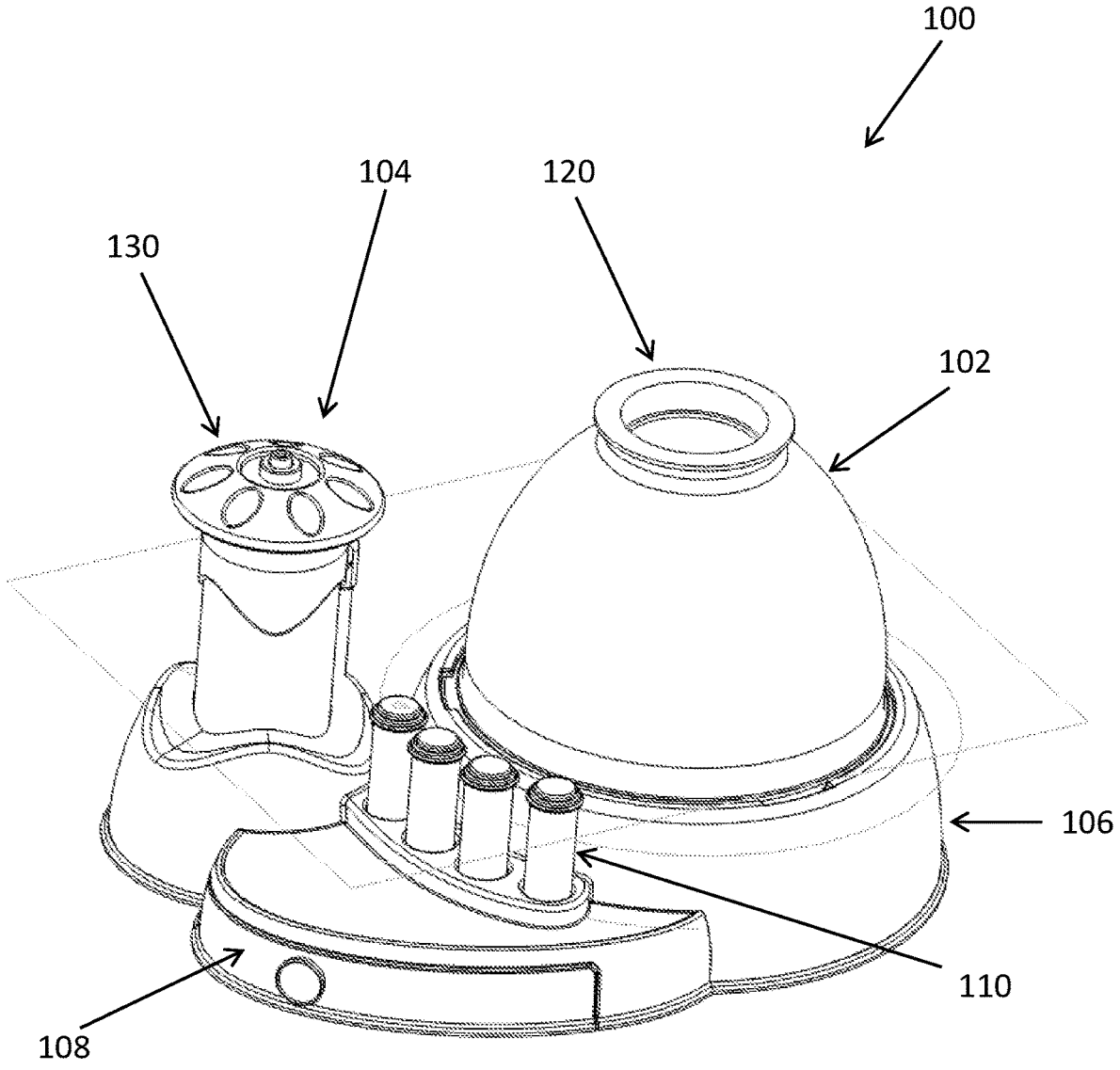
FIG. 1A is an illustration of a container inflation system in accordance with one embodiment of the present invention.
Figure 1B:
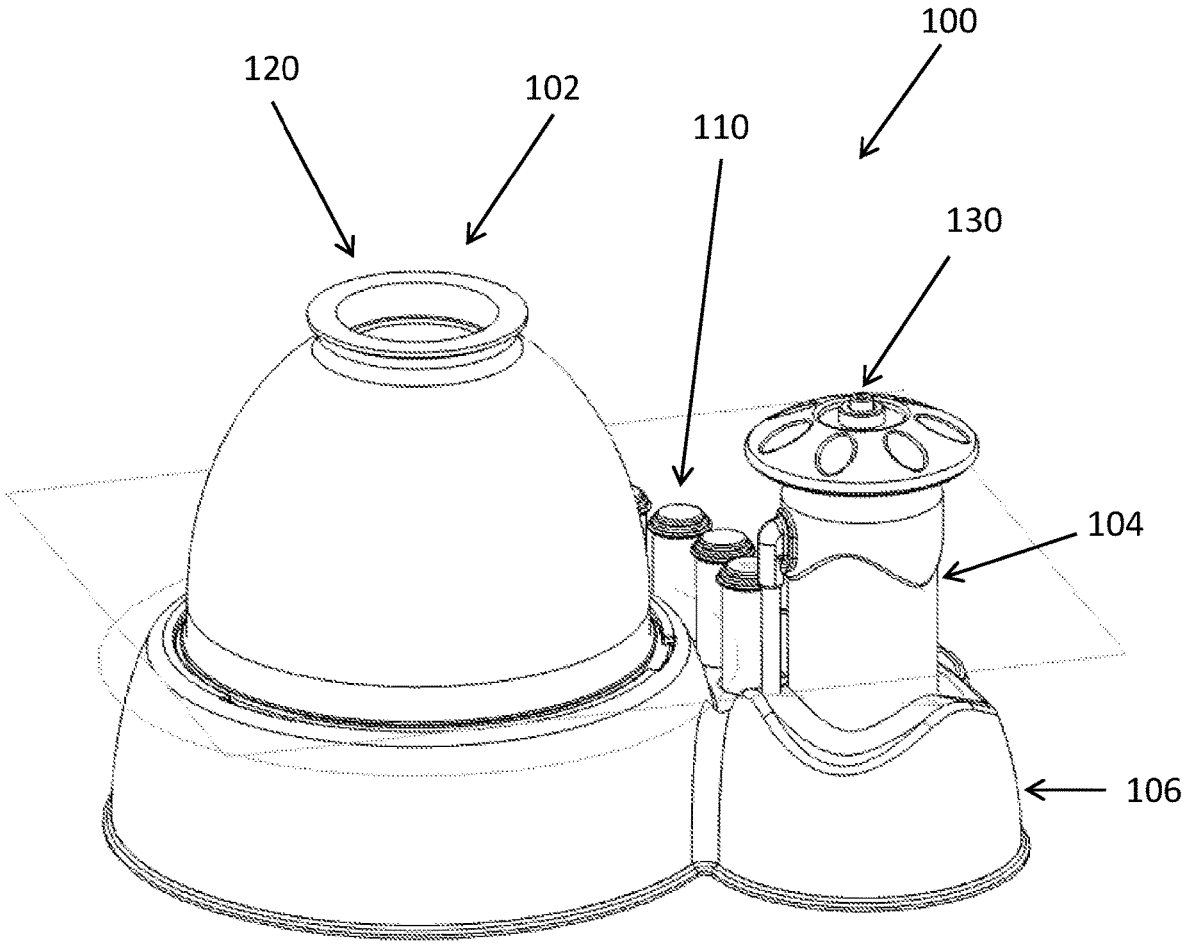
FIG. 1B is an illustration of the container inflation system of FIG. 1A.

Referring to FIGS. 1A and 1B, there is illustrated an example embodiment of a container inflator system comprising:

- a suction chamber arranged to expand the container within the suction chamber while maintaining at least one opening for accessing the container; and,
- an inflation apparatus arranged to further inflate the container when the container is removed from the suction chamber.

In this embodiment, the container inflator system 100 includes a suction chamber 102, and an inflation apparatus 104 which operate together to allow a container, such as, but not limited to a balloon (not shown), to be inflated with objects or items placed therein. Such a balloon, once inflated with objects or items, may be referred to as a "stuffed" balloon.

In this example, the suction chamber 102 is arranged to firstly expand a container such as a balloon, such that when it is expanded, the container's opening remains accessible for the insertion of objects therein. Once objects have been inserted into the container, the opening of the container may be sealed to prevent the inflating air pressure within the container from escaping when it is released from the suction chamber 102. Preferably this is performed by use of a delivery valve (not shown in FIGS. 1A and 1B, but shown in one example with respect to FIGS. 3A to 3D) arranged to seal the container so as to maintain the expanded state of the container when it is removed from the suction chamber 102. Although, as it will be appreciated by a person skilled in the art, the delivery valve is optional in some embodiments of the system 100.

Once the container is removed from the suction chamber 102, it can then be further inflated by placing the opening of the container into a position for fluid communication with an inflation apparatus 104. The inflation apparatus 104 is then arranged to further inflate the container by delivering air pressure into the container so as to further expand the container. In examples where a delivery valve is used, the delivery valve may also be arranged to be received and/or to engage with the inflation apparatus 104 such that air pressure may be delivered to the container via the delivery valve so as to further inflate the container.

In examples where the container is a balloon, a user may firstly use the suction chamber 102 to expand the balloon by use of suction pressure. The balloon may firstly be placed or inserted into the suction chamber 102 with its opening being stretched around an annular opening 120 of the suction chamber 102 so as to seal the suction chamber 102 from the atmosphere. Once in this position, a user may then apply suction pressure to the suction chamber 102 which is delivered preferably near the base 106 of the suction chamber 102 by a pumping device. In turn, the suction pressure causes the balloon to expand towards the walls of the suction chamber 102 due to the vacuum created within the suction chamber 102 and thus allowing the balloon to expand within the suction chamber 102 so as to form a balloon chamber, a space within the expanded balloon.

Once formed, this balloon chamber can be filled with various objects such as toys, decorative items such as glitter dust, papers or strings, liquids, lights, plant materials, other balloons or any other items or objects that a user may desire to place within the balloon. Upon the completion of the insertion of objects within the balloon chamber, a user may then proceed to seal the balloon such that the balloon can retain the air pressure within it when the suction pressure or vacuum is removed from the suction chamber 102. One possible method to perform this is by sealing the balloon with any sealing mechanism such as a ribbon or string tied around the balloon, or even by use of the user's digits. However, as it is undesirable to see that the balloon is deflated, since the items within may escape the balloon or may damage the internal walls of the balloon, a delivery valve is preferably used to seal the balloon. Description of an example embodiment of the delivery valve will be described below with reference to FIGS. 3A to 3D.

Once the balloon is sealed and the suction pressure is removed, the balloon can be removed from the suction chamber 102 by disassembling the housing of the suction chamber 102 away from the base 106. In preferred examples, the suction chamber 102 is formed by a dome shaped shell which is screw fitted into the base 106. This dome shaped shell can be unscrewed from the base 106 and thus allowing the balloon to be removed from the suction chamber 102. Once the balloon is removed from the suction chamber 102, the balloon may then be further inflated by delivering further inflation pressure to the balloon. This is preferably performed by the inflation apparatus 104 which in this example embodiment, as shown in FIGS. 1A to 3D, is placed adjacent to the suction chamber 102. The opening of the balloon is placed to engage with the inflation apparatus 104 so as to form a fluid communication between the balloon and the inflation apparatus 104. In turn, the inflation apparatus 104 is then operated by the user to deliver air pressure to the balloon.

As shown in this example embodiment, the inflation apparatus 104 operates with a pumping device (not shown in FIGS. 1A and 1B, but shown in FIGS. 3A and 3D) which also provides suction pressure to the suction chamber 102. By use of a valve system having one or more one-way valves, the pumping device is able to deliver both the suction pressure to the suction chamber 102 and inflation pressure to the inflation apparatus 104. This is advantageous as the usage of the same pumping device reduces the size and complexity of the container inflator system 100 while also reducing the costs of manufacturing the system 100.

Preferably, and shown in FIGS. 3A to 3D, an example of a removable delivery valve arrangement (302, 306) may be used to engage the balloon to the suction chamber 102, The delivery valve arrangement may also seal the balloon when it is desired to remove the balloon from the suction chamber 102 and may also allow further inflation pressure to be inserted within the balloon via the inflation apparatus 104. In this example, the removable delivery valve arrangement may also include a one way valve 302 which permits air pressure to be inserted into the balloon, while preventing its escape from the balloon, and/or a plurality of annular members 306 which assists to seal the balloon to the lip of the suction chamber's opening 120 while also allowing the balloon to be sealed to the valve 302 when it is required to be removed from the suction chamber 102.

The removable delivery valve arrangement is advantageous as a user can remove the balloon from the suction chamber 102 without losing the air pressure within the balloon. Furthermore, in preferred examples where the valve is arranged to couple with the inflation apparatus 104, such as via an engagement nozzle 130 that engages the valve to the inflation apparatus 104, the valve also allows the user to further inflate the balloon with the inflation apparatus 104. Upon achievement of a correct or desired inflation of the balloon, a user may then remove the delivery valve arrangement by sealing the balloon at a position adjacent to the valve, such as the neck of the balloon adjacent to its opening. This can be performed by tying a ribbon or other forms of balloon seals around the balloon. In turn, the valve arrangement is released for use with another balloon.

As shown in the example embodiment of FIGS. 1A and 1B, the suction chamber 102 and the inflation apparatus 104 are placed adjacent to each other and are housed in these positions by a housing base 106 which connects the chamber 102 to the inflation apparatus 104 to form a single container inflator device 100. As shown in FIGS. 1A and 1B, the housing 106 may also include one or more storage compartments 108 for the storage of tools, balloons or other items. Preferably, as also shown, the housing 106 may be molded to include a plurality of cylindrical slots, each arranged to receive a cylindrical container 110 to store various decorative materials. This is advantageous as these containers 110 add to the overall aesthetics of the system 100 as well as provide the proper storage of decorative materials for use and ease of access by a user.

Figure 2A:
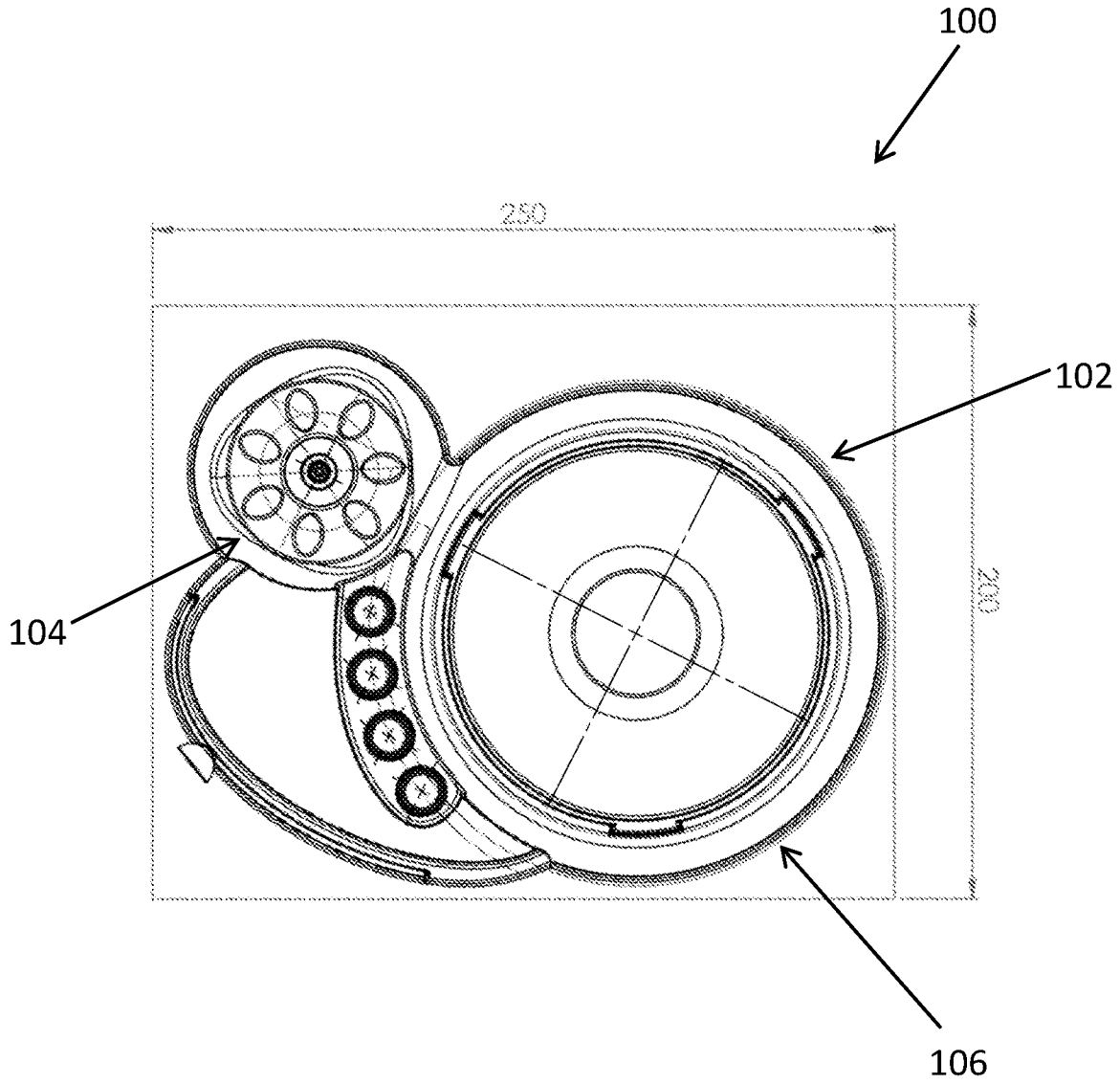
FIG. 2A is a top view of the container inflation system of FIG. 1B.
Figure 2B:
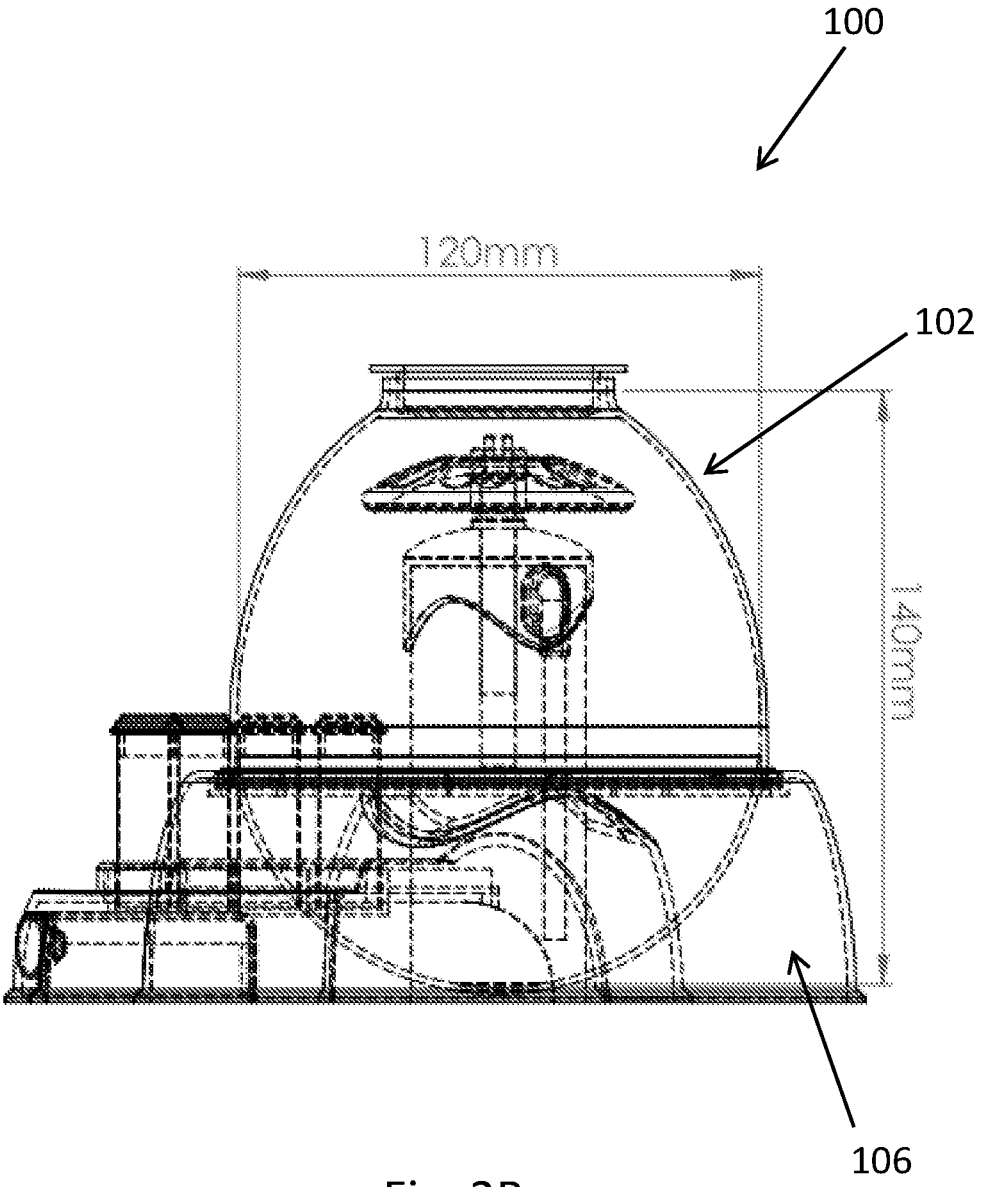
FIG. 2B is a side view of the container inflation system of FIG. 1B.
Figure 2C:
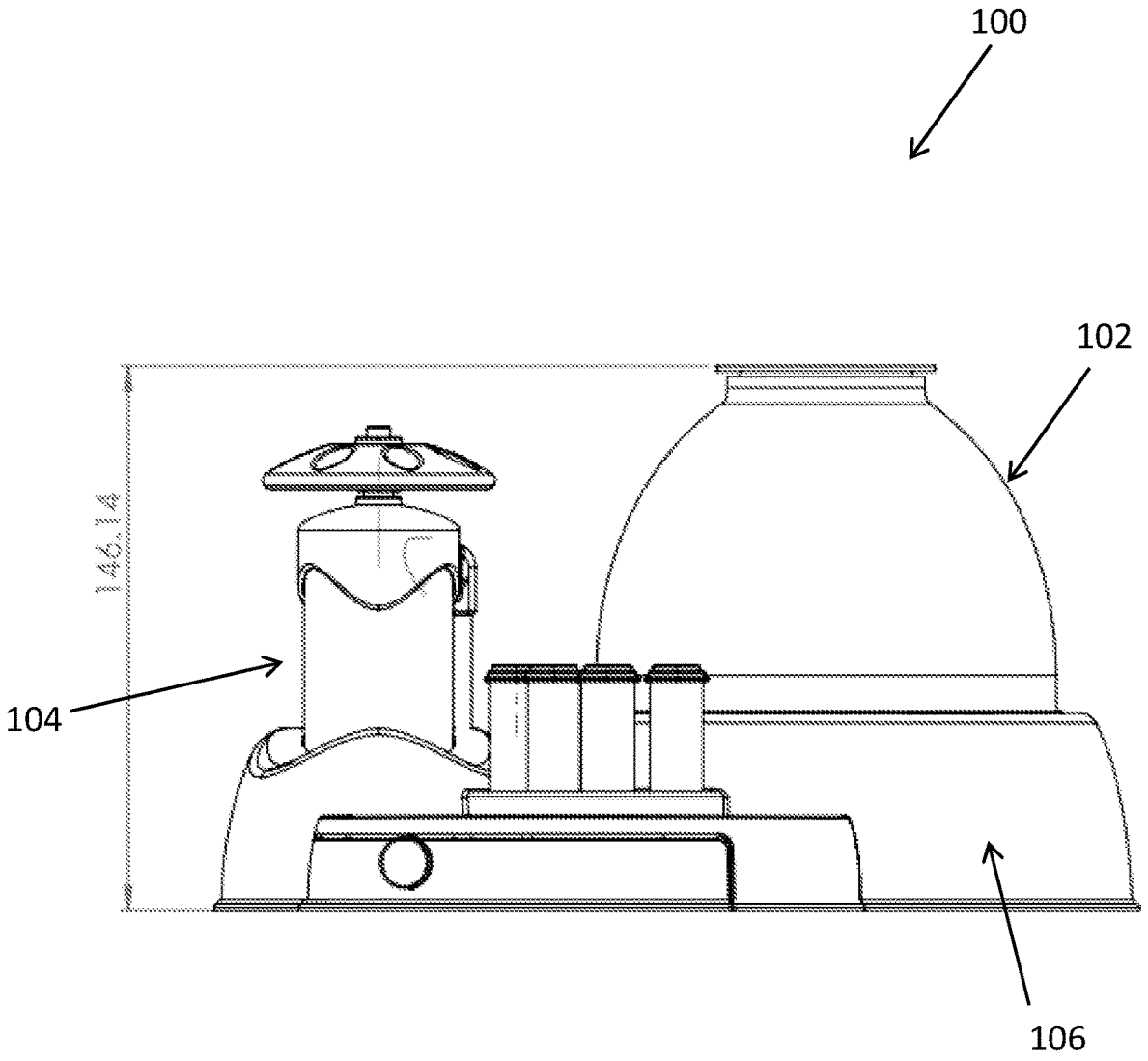
FIG. 2C is a front view of the container inflation system of FIG. 1B.

With reference to FIGS. 2A to 2C, there is illustrated the top, side and front view of an example embodiment of the container inflator system 100. These diagrams show the position of the inflator apparatus 104 and suction chamber 102 as well as the various storage compartments 108, 110. The diagrams also shown some example dimensions, which are provided for guidance only and would be appreciated by a person skilled in the art that the dimensions can vary, either with minor or significant variations.

As illustrated, the dimensions of this example embodiment of the container inflator system 100 as shown in FIG. 2A are approximately 250 mm in length and 200 mm wide. In turn, although the container inflation system 100 may be of any dimensions, this example container inflator system 100 is intended to be relatively compact and is sized to be similar to that of a typical desk toy for children. This example embodiment would therefore illustrate the advantages in that the system 100 may be used by a child at home or by a user at a party venue, without the necessity of large or complex equipment to insert objects into a balloon to make a "stuffed" balloon.

Figure 3A:
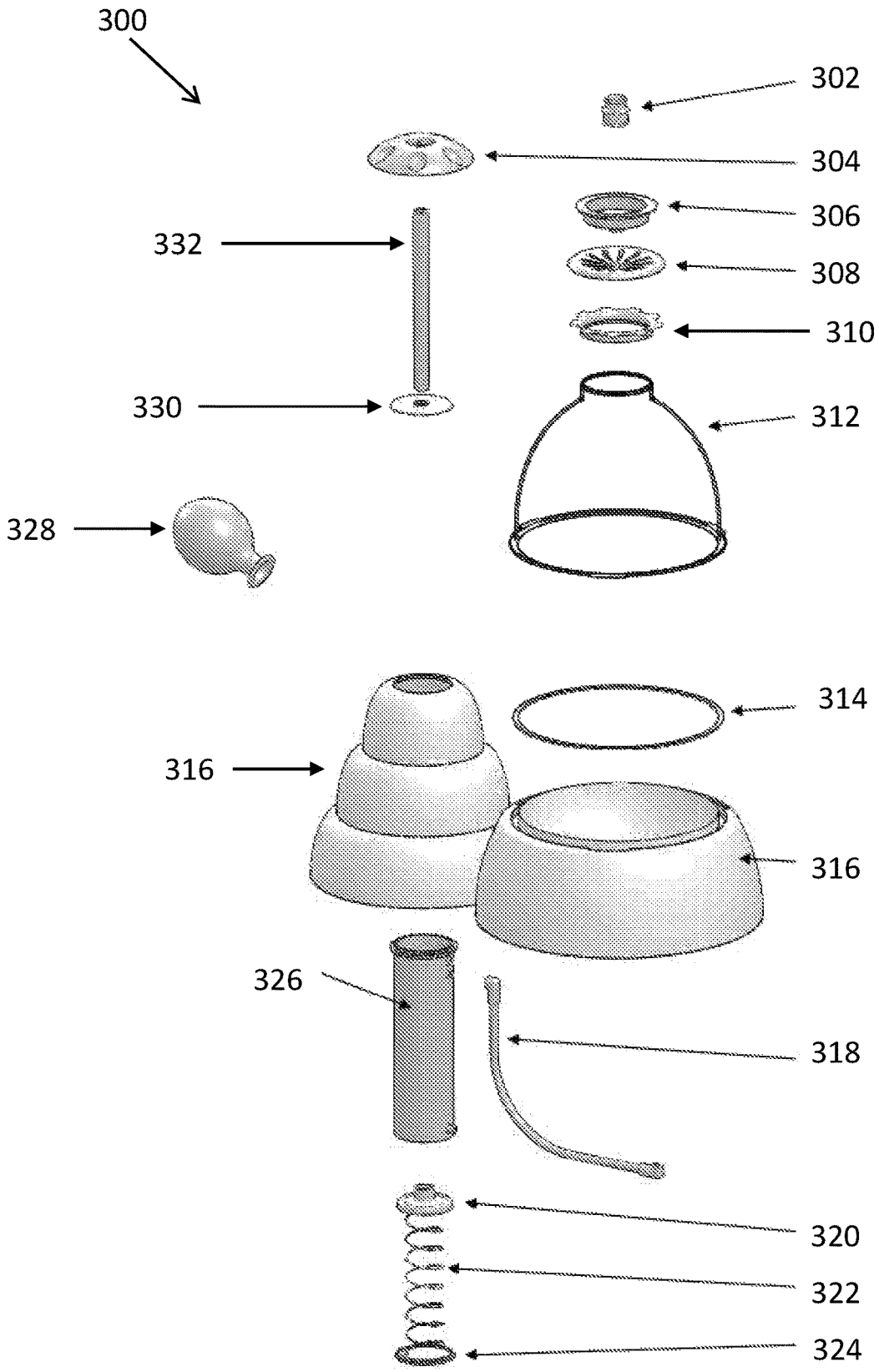
FIG. 3A is an exploded view of an example container inflation system.

With reference to FIGS. 3A to 3D, there are provided further illustrations of an example container inflator system 300 to illustrate the components of the system 300 in greater detail. As shown in FIG. 3A, which is an exploded diagram of an example container inflator system 300, for the purposes of simplicity the various containers 108, 110 that are illustrated in the examples of FIGS. 1A to 2C are not shown.

In this example embodiment, the suction chamber is formed by a base 316 and a suction chamber dome 312 which is placed over the base 316 so as to form the suction chamber. The suction chamber dome 312 is preferably sealed to the suction base 316 by screw fit and includes a rubber or soft seal 314 so to prevent suction pressure within the suction chamber to be lost through the engagement between the suction chamber dome 312 and the base 316. The base 316 preferably has an aperture disposed near towards its lowest point which is in turn connected to a fluid conduit, such as an air tube 318, which is in turn connected to a pumping system (304, 332, 330, 326, 320, 322, 324). The pumping system may then be able to provide suction pressure to the suction chamber. It is also preferred that the aperture be disposed near or towards the lowest point of the suction chamber and that it is also in communication with an annular slot (not shown) placed on the bottom of the base 316 such that the suction pressure may be evenly distributed around the chamber. This may be advantageous as the even distribution of suction pressure may ensure the balloon within the suction chamber can be expanded evenly around the suction chamber and not expanded to one side of the chamber.

In this example embodiment, the inflation apparatus is placed adjacent to the suction chamber and includes a pumping system comprising of various pump related parts (304, 332, 330, 326, 320, 322, 324) that are placed within the inflation apparatus. In this example, the pumping system is a manual pumping system that includes a pump that comprises a pump piston 332, 330, within a pump cylinder 326 and a piston spring mechanism 320, 322 324 so as to allow the pump to create suction and inflation pressure for the inflation apparatus and the suction chamber, although as it will be appreciated, an electric pump system may also be implemented in some examples.

As shown in this example, the container inflator system 300 includes a delivery valve arrangement 302, 306, 310 arranged to facilitate the sealing and transfer of the balloon from the suction chamber for further inflation by the inflation apparatus. The delivery valve arrangement may include a one way valve 302 which is arranged to ensure air pressure can be inserted into the balloon while also ensuring that air pressure cannot escape from the balloon 328. The one way valve would in turn be engaged with a plurality of annular members, including a funnel 306, and optionally a cover (not shown), which is arranged to secure the valve 302 to the balloon 328. Preferably, the annular members may also be removably engaged with the opening of the suction chamber thus allowing the balloon 328 to expand when it is secured to the suction chamber, and when desired, the delivery valve arrangement, together with the balloon 328, can be removed from the suction chamber.

In such an example arrangement, the annular members may be of a similar size to the opening of the suction chamber. Thus the balloon 328 is firstly placed within the suction chamber with its opening being stretched around the opening of the suction chamber. This creates a seal around the suction chamber and thus allows the balloon 328 to be expanded when suction is applied to the suction chamber.

Figure 3B:
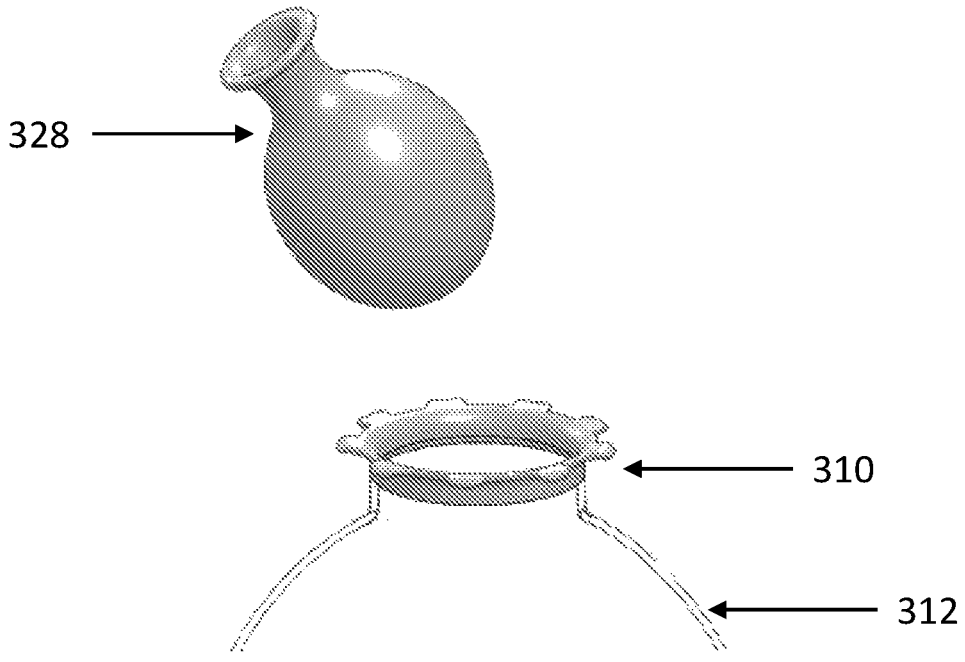
FIG. 3B illustrates an example hook ring engaged to an opening aperture of an example suction chamber of one example embodiment of the container inflation system.

As shown in this example and in FIG. 3B, a hook annular member 310 similar to a ring, may be placed around the opening of the suction chamber dome 312. Preferably, the annular member 310 has a plurality of soft and blunt hooks which help seat the opening of the balloon around the opening of the suction chamber dome 312. Thus in this example, the user may insert the balloon 328 into the suction chamber, then proceed to stretch the balloon's opening around the opening of the suction chamber by stretching the opening of the balloon around the hooks of the hook annular member 310. The hooks in turn urge the engagement of the balloon 328 in position to prevent the balloon 328 from unintentional disengagement from the opening of the suction chamber.

Figure 3C:
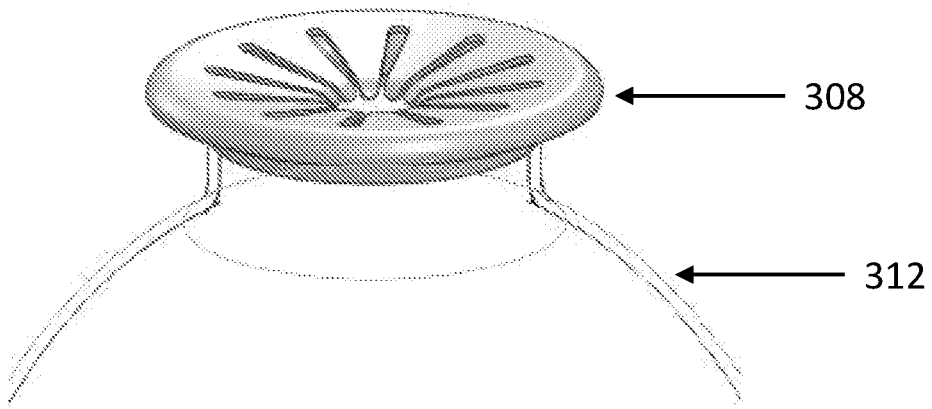
FIG. 3C illustrates a finger ring used with the opening aperture of FIG. 3B; and, FIG. 3D is a cut away view of the container inflation system of FIG. 3A.
Figure 3D:
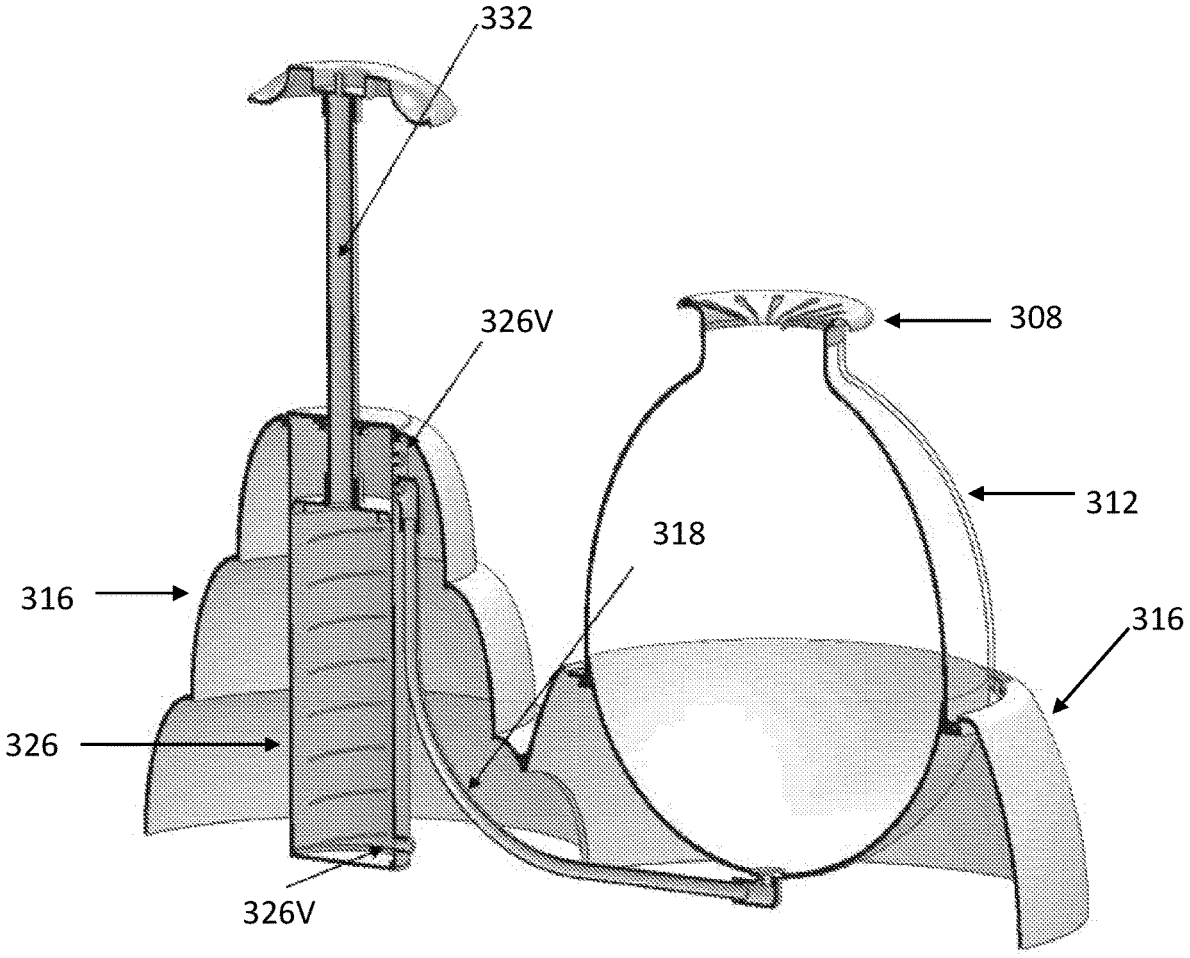

Optionally, also shown in FIG. 3C, is a fingered ring 308 which may be seated over the opening of the balloon and the suction chamber. The fingered ring 308 includes a plurality of flexible fingers which bend to allow various objects or items to be inserted into the balloon 328 when the balloon is inflated within the suction chamber. The ring 308, which can be removed when it is desirable to seal the balloon with the delivery valve, is arranged to protect the neck of the balloon 328 from scrapes or physical damage when objects or items are inserted into the balloon 328. This is particularly advantageous when larger or hard objects are inserted into the balloon such as soft toys or LED lights that have harder and sharper surfaces exposed such as batteries or wiring circuits.

After a user inserts various objects or items into the expanded balloon sitting within the suction chamber, the user can insert the delivery valve arrangement into the neck of the balloon 328, which at present has been stretched around the opening of the suction chamber. As the flanged portions of the delivery valve is similar, although slightly smaller in size, to the opening of the suction chamber, the user can insert the delivery valve arrangement over the opening of the suction chamber with a near snug fit over the opening of the balloon. The near snug fit should be sufficiently loose so as not to damage the balloon 328, but should be preferably near the size of the stretched opening of the balloon 328 so as to facilitate an easy seal of the balloon 328. Preferably, a soft or rubbery ring, similar to an O-ring, can be used along the edges of the annular members 306 such that it can be inserted into the stretched opening of the balloon 328 to form a seal with the balloon 328, while also permitting it to travel through the opening of the suction chamber so that the balloon 328 can be removed from the chamber.

When the delivery valve arrangement is inserted into the stretched opening of the balloon 328, the user may then further seal the balloon's opening to the delivery valve arrangement. This can be performed in various ways depending on a preferred implementation of the annular members 306 of the delivery valve arrangements. Preferably, in the above example, when the user inserts the delivery valve arrangement, the O-ring of the valve will then form a seal with the stretched balloon 328. The user may then cover this seal with a cap (not shown) to secure the balloon to the O-ring so as to form a more secure seal of the balloon 328 to the valve 302. Once secured, the user can remove the suction chamber dome 312 from the base 316, preferably, by rotating the suction chamber dome 312 away from the base 316 via its screw fit arrangement. Once removed, the user can push the delivery valve arrangement through the opening of the suction chamber dome 312, together with the balloon 328 which could now be freed from the suction chamber dome 312.

The user may then further inflate the balloon 328 to a larger size by now inserting the delivery valve arrangement to the inflation apparatus adjacent to the suction chamber. Once inserted into inflation apparatus, the user can operate the pump to further inflate the balloon 328. The inflation apparatus, as shown in this example, includes a manual pumping system which has a piston 332, 330, pump cylinder 326 and spring unit 320, 322, 324. The pumping system is also connected to the inflation apparatus and the suction chamber with a valve arrangement 326V that includes a plurality of one way valves 326V such that suction pressure can be delivered to the suction chamber while inflation pressure can be directed to the inflation apparatus when the pump piston 332 is operated by a user.

Once the balloon 328 has been inflated to a suitable air pressure, the balloon 328 can be disengaged from the delivery valve arrangement by firstly sealing the opening of the balloon 328. This may be performed by simply tying the portions of the balloon 328 adjacent to its opening, commonly the neck of a standard balloon, with a ribbon, string, or similar balloon sealing devices. The delivery valve arrangement may in turn be disengaged from the balloon 328 and may be used with another balloon.

The present example embodiments of the container inflator system 100, 300, may be advantageous as it is able to assist users to make a "stuffed" balloon without complex equipment. Additionally, as the suction chamber and the inflation apparatus may be integrated into the same unit, the system 100, 300 may also be easy to use, compact to store and transport and low cost to manufacture. In turn, rendering the system 100, 300 practical as a domestic toy for children and adults.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A container inflator system comprising:

a suction chamber configured to expand a container within the suction chamber into an expanded state; and a pumping system connected to the suction chamber by a valve arrangement to evacuate the suction chamber by manual operation of the pumping system while maintaining at least one opening for accessing the container when within the suction chamber, wherein after the container in the expanded state is removed from the suction chamber and moved onto the pumping system, the pumping system is manually operable to inflate the container further by the valve arrangement.

2. The container inflator system in accordance with claim 1, wherein the pumping system is operated by a pumping device to deliver suction pressure to the suction chamber by manually pumping the pumping device when the container is in the suction chamber and inflation pressure to the container by manually pumping the pumping device after the container is moved from the suction chamber onto the pumping system.

3. The container inflator system in accordance with claim 2, wherein the pumping device includes a cylinder connected to the valve arrangement to deliver suction pressure to the suction chamber and inflation pressure to the container by strokes of a piston of the cylinder.

4. The container inflator system in accordance with claim 1, further comprising a delivery valve configured to seal the container so as to maintain the expanded state of the container when it is removed from the suction chamber.

5. The container inflator system in accordance with claim 4, wherein the delivery valve is configured to deliver inflation pressure from the pumping system to the container when moved onto the pumping system.

6. The container inflator system in accordance with claim 5, wherein the valve arrangement includes a plurality of one-way valves configured to create the suction pressure and the inflation pressure when the pumping device is operated.

7. A container inflator system comprising:

a suction chamber configured to expand a container within the suction chamber into an expanded state while maintaining at least one opening for accessing the container; and an inflation apparatus configured to further inflate the container when the container is removed from the suction chamber, wherein the inflation apparatus and the suction chamber are operated by a pumping device, wherein the pumping device includes a valve arrangement configured to deliver suction pressure to the suction chamber, wherein the valve arrangement is further configured to deliver inflation pressure to the inflation apparatus, wherein the valve arrangement includes a plurality of one-way valves configured to create the suction pressure and the inflation pressure when the pumping device is actuated, and wherein the pumping device includes a cylinder connected to the valve arrangement.

8. The container inflator system in accordance with claim 1, wherein the container is a balloon.

9. The container inflator system in accordance with claim 7, wherein the container is a balloon.

10. The container inflator system in accordance with claim 7, wherein the plurality of one-way valves are configured such that each of the suction pressure and the inflation pressure are created by a respective stroke of a piston of the cylinder.

11. The container inflator system in accordance with claim 10, wherein the suction chamber is defined by a dome member configured for engagement with a base portion.

12. The container inflator system in accordance with claim 11, wherein the dome member is engaged to the base portion by a screw fit.

13. The container inflator system in accordance with claim 11, wherein the base portion is part of a base member configured to engage with the inflation apparatus.

14. The container inflator system in accordance with claim 13, wherein the base member includes one or more storage compartments.

15. A method for inflating a balloon comprising:

expanding a balloon by using suction pressure, further inflating the balloon by delivering inflation pressure to the balloon, wherein the suction pressure and the inflation pressure are provided by a same pumping device, and inserting objects into the balloon, wherein said inserting objects into the balloon is performed after the balloon is expanded by the suction pressure and before the balloon is further inflated by the inflation pressure, and wherein the same pumping device is operated manually by a user with a linear stroking motion.

16. The method for inflating a balloon in accordance with claim 15, wherein the pumping device includes a valve arrangement configured to direct suction pressure to the balloon and inflation pressure to the balloon.

17. The method for inflating a balloon in accordance with claim 15, further comprising sealing the balloon after the balloon is expanded by the suction pressure.

18. The method for inflating a balloon in accordance claim 17, wherein the sealing of the balloon is performed by a delivery valve.

19. The method for inflating a balloon in accordance with claim 18, wherein the delivery valve is configured to couple with the pumping device to inflate the balloon.

20. A method for inflating a balloon comprising:

expanding a balloon by using suction pressure; and further inflating the balloon by delivering inflation pressure to the balloon, wherein the suction pressure and the inflation pressure are provided by a same pumping device, wherein the same pumping device is operated manually by a user with a linear stroking motion.

21. A balloon inflator system (100) configured to carry out the method of claim 20, comprising:

a suction chamber (102); and an inflation apparatus (104) for said expanding the balloon by delivering suction pressure to the suction chamber with the balloon inside the suction chamber and for said further inflating the balloon after removal from the suction chamber and connected to the inflation apparatus by delivering inflation pressure to the balloon.

* * * * *